United States Patent [19]

Eppinger

[11] Patent Number: 4,643,014

[45] Date of Patent: Feb. 17, 1987

[54] VEHICLE SUPPORT ASSEMBLY

[76] Inventor: Timothy L. Eppinger, 119 E. Grandview Ave., Zelienople, Pa. 16063

[21] Appl. No.: 786,684

[22] Filed: Oct. 11, 1985

[51] Int. Cl.[4] ..... B21D 1/12

[52] U.S. Cl. ..... 72/305; 72/705; 248/676

[58] Field of Search ..... 72/305, 705; 269/296; 248/163.1, 676

[56] References Cited

U.S. PATENT DOCUMENTS

| | | | |
|---|---|---|---|
| 3,091,278 | 5/1963 | Padgett | 72/705 |
| 3,722,881 | 3/1973 | Vilotti | 248/163.1 |
| 4,337,636 | 7/1982 | Clausen | 72/705 |
| 4,516,423 | 5/1985 | Reich | 72/705 |

FOREIGN PATENT DOCUMENTS

| | | | |
|---|---|---|---|
| 85864 | 3/1896 | Fed. Rep. of Germany | 248/676 |

*Primary Examiner*—Lowell A. Larson

*Attorney, Agent, or Firm*—George C. Atwell

[57] ABSTRACT

A support assembly for stationarily securing an automobile or similar vehicle in an elevated, substantially level position on a floor surface. The assembly includes a pair of bench structures adapted for rigid positioning and spaced parallel orientation beneath a vehicle whereby each bench structure is transverse to the vehicle body and within the area defined by the forward and rear wheels of the vehicle. Each bench structure has a rigid crossbeam extending between A-frame pedestals, body clamping devices adjustably secured on the upward face of the crossbeam, and means for securement of the benches in working position.

7 Claims, 7 Drawing Figures

VEHICLE SUPPORT ASSEMBLY

BACKGROUND OF THE INVENTION

This invention relates generally to apparatus utilized for rigidly positioning an automobile or vehicle for the performance of body repair work thereon, and specifically pertains to a support assembly for a vehicle body which is adapted to be securely floor-anchored and to grip directly to the lateral lower edges of the vehicle body and maintain it in working position while forces are applied thereagainst in areas of the body undergoing repair.

In the prior art, various structural arrangements have been devised for supportably securing an automobile body in an elevated position to facilitate the performance of body repair work for frame corrective measures thereon. Typical apparatus designed for such function is disclosed in U.S. Pat. Nos. 4,050,287; 4,281,532; 4,289,016; and 4,463,937. The prior art also discloses various selectively positionable devices for directly clamping to the vehicle body and securing it in working position. Such devices are disclosed, for example, in several of the aforementioned patents and also in U.S. Pat. Nos. 4,296,624; 4,344,314; and 4,400,969.

Elaborate and relatively costly equipment for use in vehicle body repair does not normally find its way into the small or medium sized body repair shop. Vehicle body support systems of the prior art are generally quite expensive and out of reach to the typical independent repair shop operator.

Other less elaborate equipment has been devised for securing an automobile body in position to withstand the application of pushing and pulling forces involved in body straightening work which lack the versatility of more elaborate systems but are comparatively less expensive. Typical of this type of apparatus is the vehicle straightening assembly disclosed is U.S. Pat. No. 3,796,084 wherein a continuous ring-like anchoring track is floor-mounted to encircle the vehicle and enable a counteracting tensioning force to be applied at one point on the vehicle to offset a pulling force exerted at an opposite repair point on the vehicle.

SUMMARY OF THE INVENTION

The present invention comprehends the provision of a support assembly for stationarily securing an automobile in an elevated, substantially level position on a floor surface and gripping the body in at least four outward peripheral points, in a quadrant pattern, and firmly securing it to resist pushing and pulling forces exerted thereon during repair operations. The presently preferred embodiment of the support assembly of this invention includes a pair of portable floor-supported benches adapted to be anchored under longitudinally directed tension.

Each bench of the assembly comprises a pair of spaced-apart pedestals adapted for interconnection by an elongated crossbeam. Each of the pedestals has a vertically-oriented weight-bearing portion which terminates upwardly in an integral pocket. The pocket, which has an inwardly-facing opening and a tension leg projecting in a direction generally opposite from the opening, is adapted to interfit with an end of the crossbeam. The pocket has a back plate portion against which the end of the crossbeam abuts, and means for securing the end of the crossbeam to the back plate. The tension leg is preferably an integral, lateral extension of the pedestal and has outer end means for connecting with a floor anchor. The means of connecting the back plate of the pocket with the end of the crossbeam is adapted to draw the crossbeam and the tensioning leg toward each other to create a pulling, tensioning force longitudinal of the bench structure, between the opposite outer ends of the tension leg at each end of the bench structure, and thereby hold the bench structure in tensioned position between two anchor points on the floor surface.

The upper face of the crossbeam of each bench structure of the assembly is provided with at least two clamping devices which can be adjustably positioned longitudinally on the crossbeam to grip the downwardly projecting weld strip of the rocker panel of a vehicle supported by the assembly.

It is a primary object of the present invention to provide a portable vehicle support assembly which is relatively inexpensive to manufacture and is easily adaptable for use in the typical automobile body repair location.

It is also an object of the present invention to provide a vehicle support assembly as heretoforth described which is adaptable for use with various sized vehicles, particularly those having a unibody construction.

Various other objectives, features and characteristics of the invention will be appreciated from the ensuing detailed description.

DETAILED DESCRIPTION OF THE PREFERRED EMBODIMENT

Figure 1:
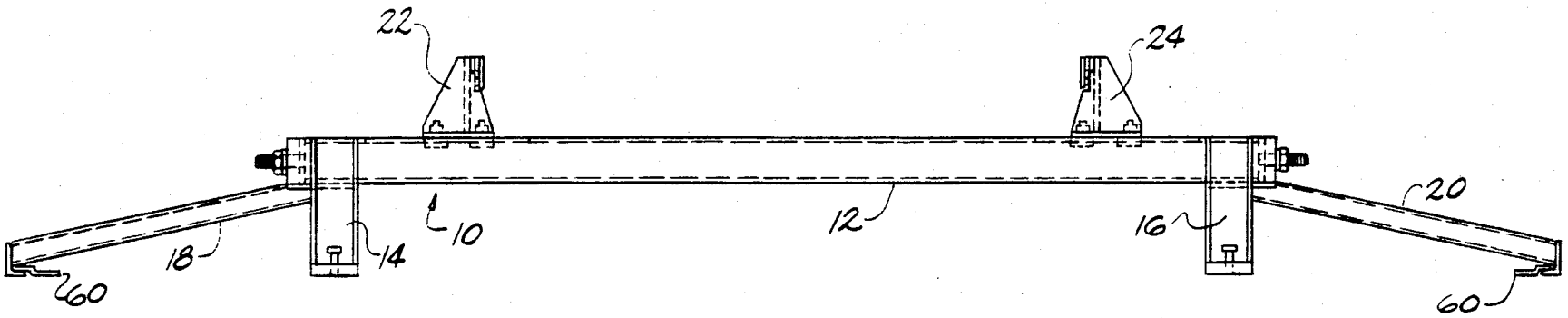
FIG. 1 is a side elevational view of bench structure utilized in the support assembly of the present invention.

In FIG. 1 there is shown a bench structure 10 which forms a constituent part of the present invention. The bench structure 10 comprises an elongated rigid crossbeam 12 supported at its end by rigid pedestals 14 and 16. Each of the pedestals 14 and 16 has respective outwardly-downwardly extending integral rigid tension legs identified as legs 18 and 20. Mounted on the upper face of the crossbeam 12 is a pair of clamping devices 22 and 24.

Figure 2:
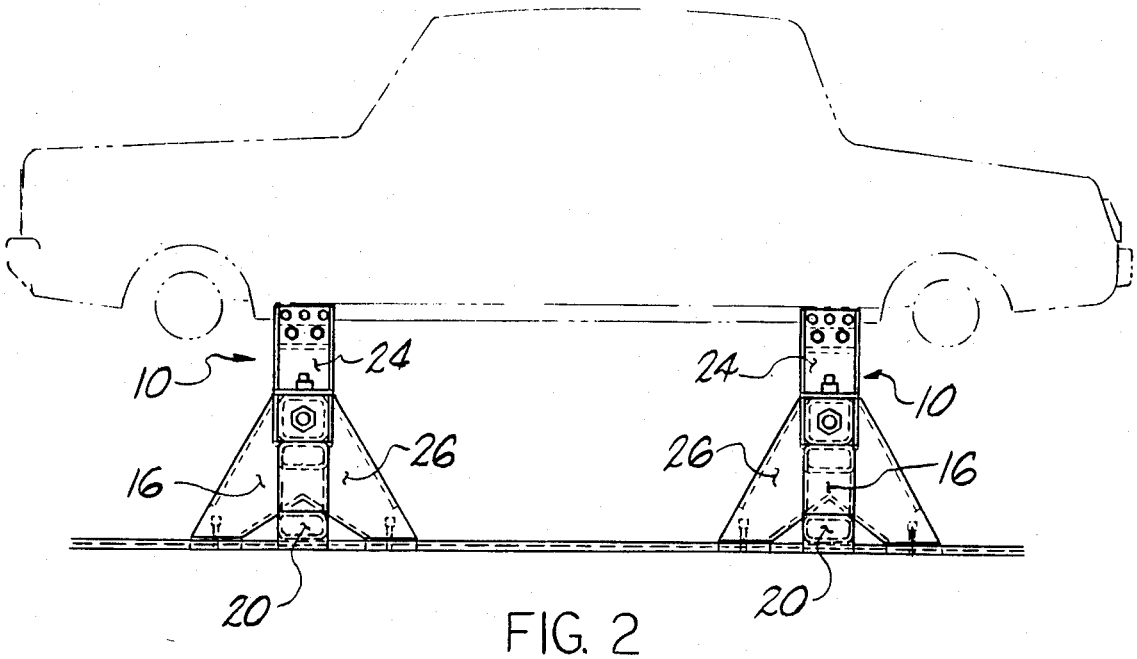
FIG. 2 illustrates end elevational views of two of the bench structures first shown in FIG. 1, in their spaced operational position supporting a vehicle body in accordance with the present invention.

FIG. 2 illustrates that the support assembly of the present invention utilizes a pair of the bench structures 10 shown in FIG. 1, disposed in spaced-apart parallel relation to support a vehicle from beneath, in the area of the body between the front and back wheels thereof.

Figure 3:
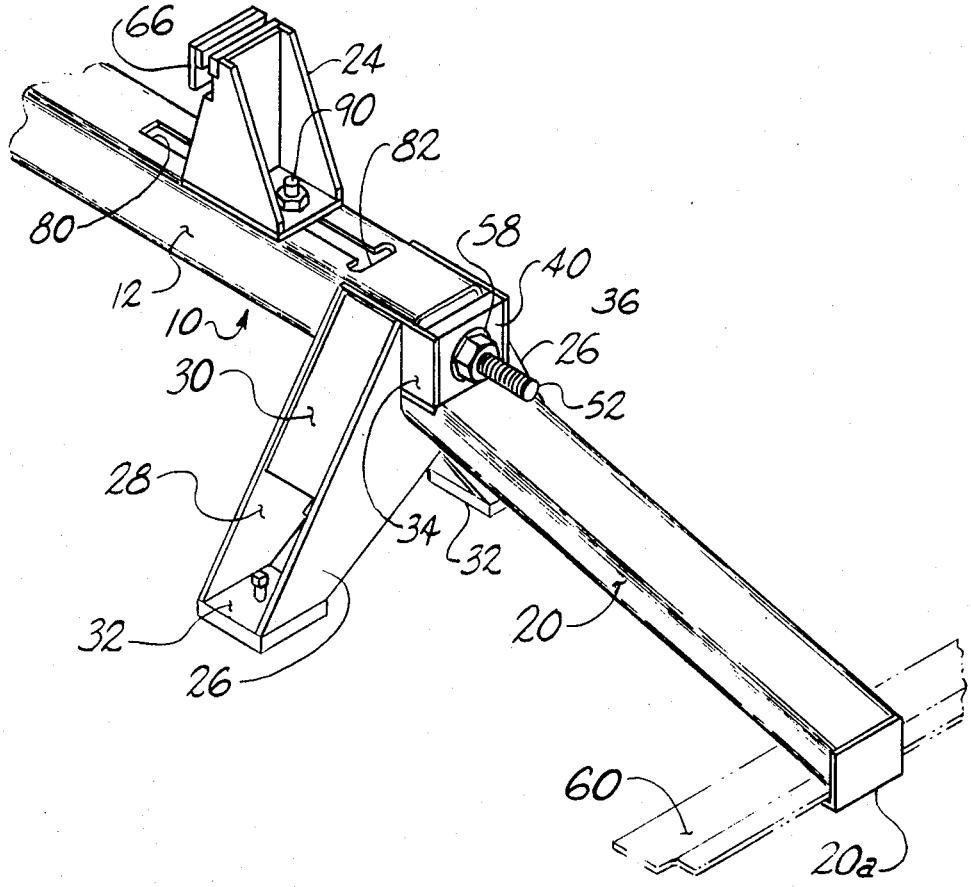
FIG. 3 is a partial isometric view of one end of the structure first shown in FIG. 1, in an enlarged scale as compared to FIG. 1.
Figure 4:
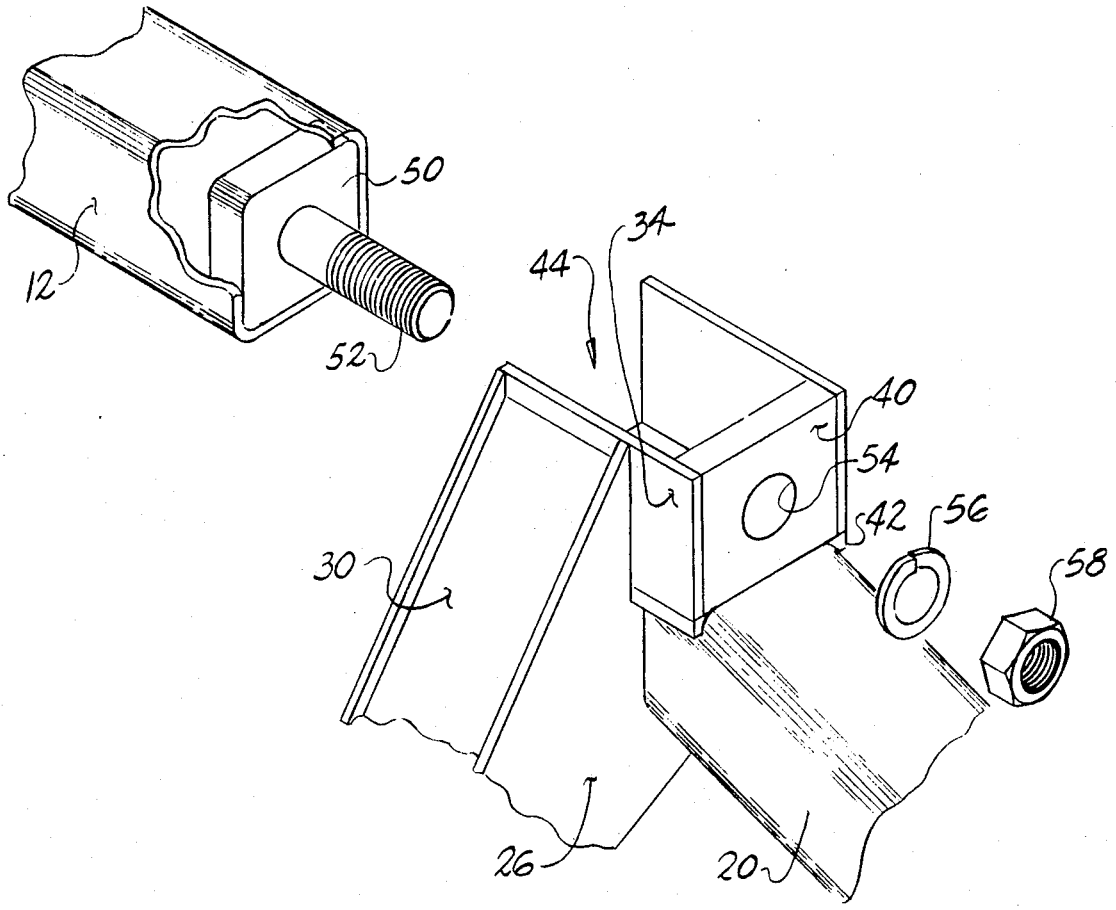
FIG. 4 is a fragmentary isometric view illustrating an assembly layout of structure first shown in FIG. 1, and shown in enlarged scale as compared to FIG. 1.

As best seen in FIG. 3, each of the pedestals 14 and 16 (only pedestal 16 is shown) has an A-frame configuration formed from rigid planar metal plate members. Specifically, with reference to FIG. 3, the pedestal 16 (which is identical in construction to the pedestal 14) is formed from spaced-apart end plate members 26 and 28 which are continuous through to both legs of the A-frame and are weldably joined by spacer plate members 30 and foot plate members 32. At their upper ends, the plate members 26 and 28 are downwardly recessed to accomodate vertically extending spaced-apart plate members 34 and 36 which, in combination with a crossplate member or back plate portion 40 and a floor plate member 42, define a rectilinear pocket 44, as shown in FIG. 4.

The rigid crossbeam 12 is a girder, rectilinear in cross-section, and has its ends closed by end plates 50, each of which is insertably fitted and welded in place. Each end plate 50 has an integral outwardly protruding stud 52 which is insertably received through an opening 54 in the back plate portion 40 when the bench structure 10 is assembled. Lock washer 56 and threaded nut 58 are provided for fastening the stud 52 in position through the opening 54.

When the bench structure 10 is assembled to the configuration shown in FIG. 1, the crossbeam 12 is disposed between the pedestals 14 and 16 whereby the ends of the crossbeam 12 reside within the recesses or pockets 44 of each of the pedestals 14 and 16. The overall size of the bench structure 10 is such that with its outwardly extending tension legs 18 and 20, its longitudinal expanse is essentially the same as the normal distance between the opposite side fixed anchor plates of a rigid anchor track such as that disclosed in aforementioned U.S. Pat. No. 3,796,084. Such anchor tracks are quite often already in place in the typical auto-body shop and can be utilized with the present invention. Alternatively, short anchor plate sections (not shown) can be installed to accomodate the present invention.

The bench structure 10 is shown in FIG. 3 in its installed relation to an anchor plate 60. The tension arm 20 has an integral hooked end 20*a* which catches a raised outer edge of the anchor plate 60. The same anchor plate connection is made at each end of the bench structure 10, and a tensioning force is applied longitudinally through the bench structure by tightening the respective nuts 58 on the studs 52 whereby each pedestal 14 and 16 is slid slightly toward the other to draw the tension legs 18 and 20 (FIG. 1) inwardly to exert a tensioning force against their respective anchor plates.

Figure 5:
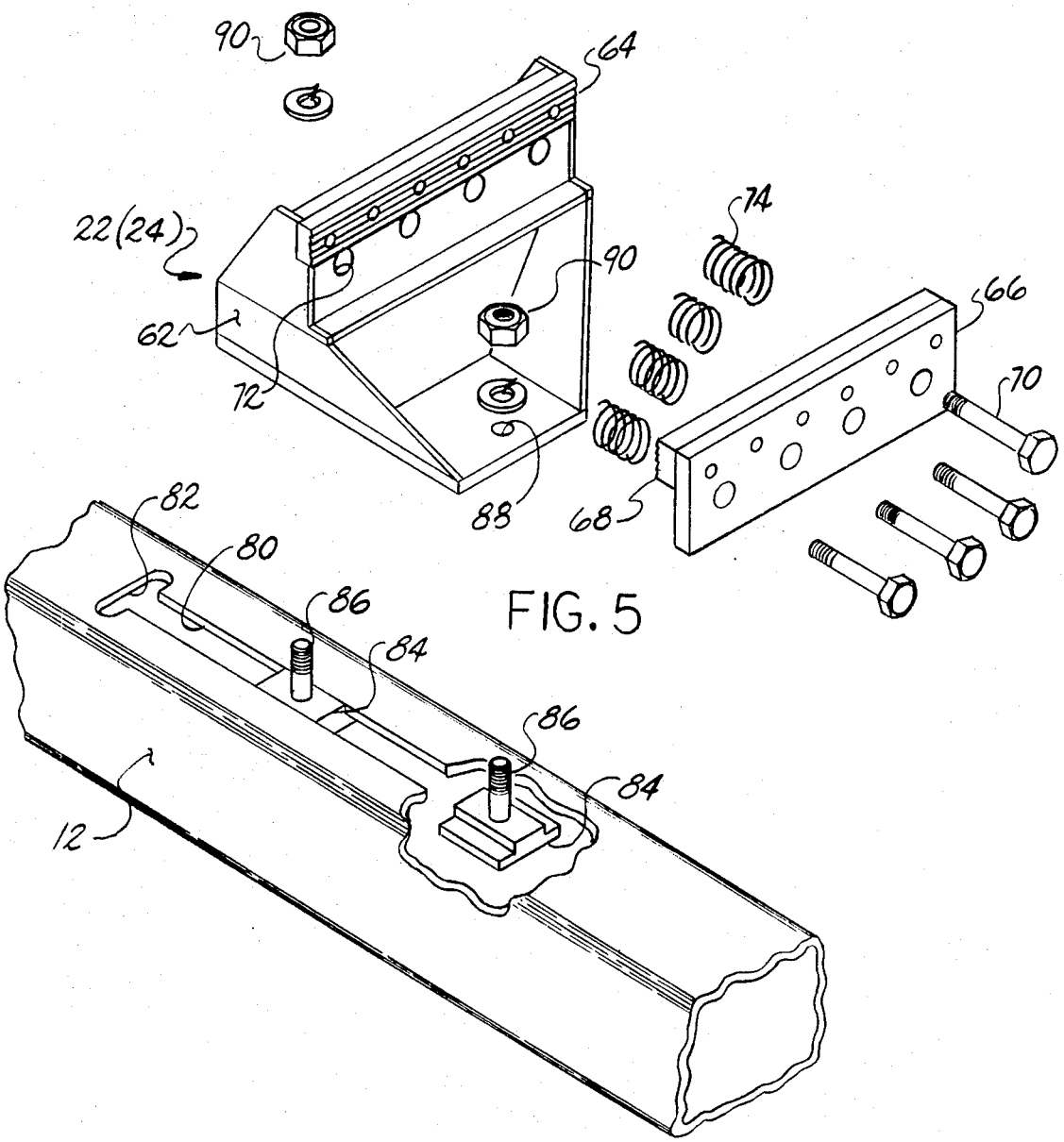
FIG. 5 is an exploded isometric view of certain components of the structure first shown in FIG. 1 and shown in an enlarged scale in relation thereto.

In FIG. 5 the details of the preferred form of the clamping devices 22 and 24 are shown. Each clamping device 22 and 24 comprises a base portion 62 having a clamping face 64. The clamping device further includes a retractable clamping plate 66 having a clamping face 68. The clamping plate 66 is affixed to the clamping base portion 62 by means of four spaced-apart threaded bolts 70 which threadably register in respective threaded apertures 72. Spring members 74 are carried on the respective bolts 70 to exert an opening force on the clamping plate 66.

FIG. 5 also shows that the crossbeam 12 is provided, on its upwardly facing surface, with an elongated slot 80 having a laterally widened end 82. A pair of T-bolt members 84 are provided for slidable retention in the slot 80. Each T-bolt member has an integral upwardly projecting stud 86 which project upwardly through spaced-apart apertures (such as aperture 88) to enable securement of the clamping device onto the crossbeam 12 by the use of threaded nuts 90.

Figure 6:
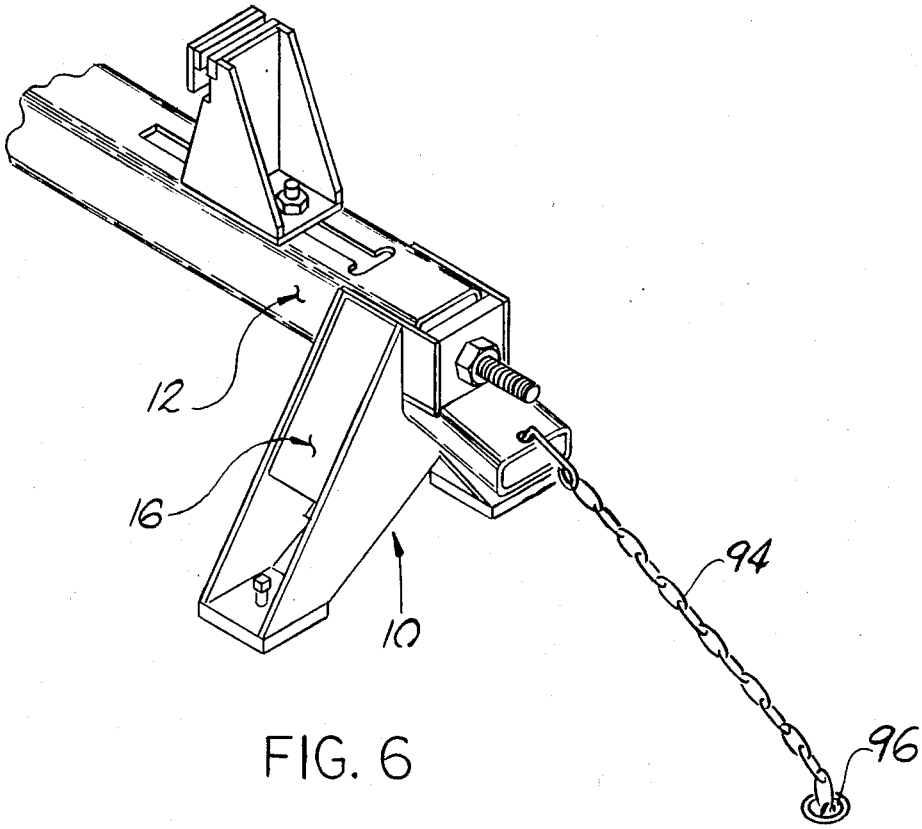
FIG. 6 is an isometric fragmentary view of bench structure of the present invention utilizing an alternative anchoring means.

FIG. 6 discloses a variation of the presently preferred embodiment or an alternate form of the present invention wherein the concept of longitudinal tensioning for anchoring the bench structure is accomplished by a chain 94 substituted for the rigid tension legs heretofore disclosed. In many repair shop locations, provision has already been made for prior art body work equipment which includes a plurality of pots (such as pot 96 shown in FIG. 6) which are embedded in the concrete floor and form an encircling pattern in a configuration similar to the anchoring track heretofore described. Such pots contain anchor means and are normally utilized as a fixed connecting point to draw against when pulling a damaged body panel in an outward direction from the vehicle parked within the pot pattern. In a shop having such pots installed in the floor, the support assembly of the present invention can be utilized by positioning each bench between opposite pot sets and connecting each pedestal by a linking chain to the adjacent pot. Longitudinal tension through the bench structure can then be applied by drawing each end of the crossbeam 12 into the pocket 44 and against the back plate 40, as heretofore described in reference to FIGS. 3 and 4.

Figure 7:
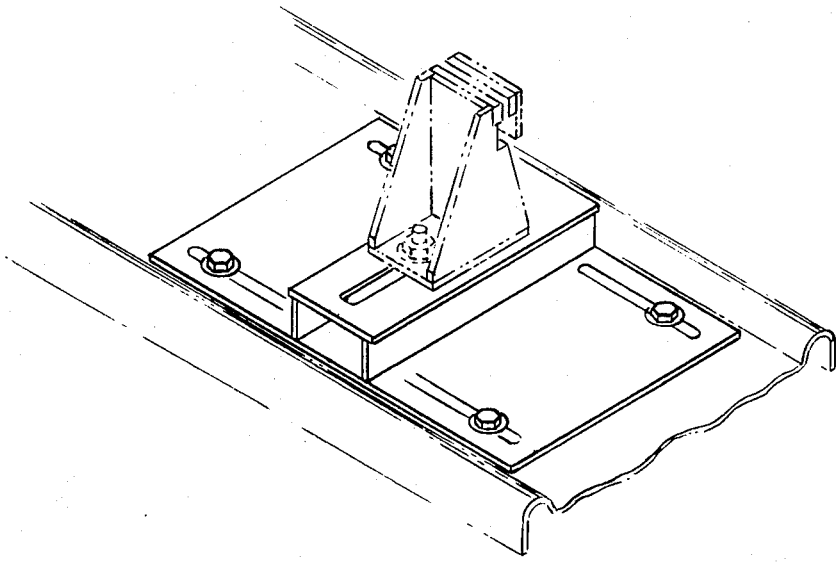
FIG. 7 is a modified view of part of the vehicle support assembly of the present invention, which is adaptable to certain equipment already available in many body shop or automobile garage locations.

Certain features and characteristics of the invention heretofore described in reference to the presently preferred embodiment, can be adapted for utilization in combination with other existing prior art equipment. For example, FIG. 7 illustrates an adaptation of the slot 80 (see FIG. 5) provided in a rigidly mounted horizontal plate member 98 which is spaced above a base plate member 100. The base plate member 94 is provided with slots 102 to enable the longitudinal adjustment of a hoist-type treadway commonly utilized for vehicle repair work. Four of the portable structures, identified by the numeral 97 in FIG. 7 would be used, two on each treadway, and holes would be drilled in the treadway in registration with the slots to enable insertion of bolt fasteners. Each structure 97 would act as a rigid base for supporting a gripping device 22 (see FIG. 5) whereby a vehicle body could be held immobile on the treadway and resistive to extreme pulling forces applied to the body during repair operations. The aforedescribed variation takes advantage of already existing treadway or ramp means whereby the vehicle can be driven into position and then suitably vertically jacked to permit positioning of the gripping devices at four points on the body structure.

Having heretofore described the various parts of the bench structures making up the support assembly of the present invention, its installation, use and operation can now be briefly described. In its preferred form, the support assembly of the present invention may be assembled or disassembled by one man so it is not necessary to leave it in place, occupying a stall which can be otherwise utilized, except when assembly is needed to perform autobody repair. When needed, the dismantled bench structures can be quickly assembled and positioned under a vehicle already jacked above the level of the upper end of the gripping devices. Once each bench structure is placed in tension as heretofore described, the gripping devices may be properly positioned along the length of the crossbeam, into alignment with the quarter panel weld bead so that the jaws of each gripping device can be firmly locked on the weld bead. The jacking equipment employed to hoist the vehicle into position is then removed, and repair work on the vehicle body may begin. Conventional known means for hydraulically stretching damaged body panels can then be employed at any point about the vehicle without the need of a counteracting stabilizing chain or other means on the opposite side of the vehicle, as normally required when the vehicle is permitted to rest on its tires or is supported from beneath by jack stands or other less rigid structures.

A particular feature of each bench structure herein disclosed is the manner in which the gripping devices, such as 22 shown in FIG. 5, are adjustably secured to the girder which serves as the crossbeam 12. The slot 80 is provided with a widened T-shaped end 82 to accomodate insertion of the T-nuts 84. Each T-nut 84 is configured to track within the slot 80 and is stepped to have a center portion which registers within the slot and opposite lateral projections which underlie the crossbeam portion defining the slot. The apertures 88 (only one of which is shown in FIG. 5) in the base portion of the gripping device 22 are placed close enough to the adjacent edge of the base portion to accomodate installation. Each T-bolt is canted and slipped downwardly through the widened slot portion 82, and the installer's finger can be extended through the slot and beneath the T-bolt to hold it is position while the gripping device 22 is properly positioned for completion of the fastening operation by application of the nuts 90. The nuts 90 are initially loosely applied whereby the gripping device 22 can be slid longitudinally along the slot 80 to align the gripping device with the vehicle quarter panel weld bead. The nuts 90 are snugly tightened, once all four gripping devices are thus positioned, and the vehicle body is lowered to permit the final clamping operation.

A comparison of FIGS. 5 and 6 shows that the gripping device of the invention may be provided in alternate sizes which provides a selection consistent with the size and weight of the vehicle to be supported by the support assembly. The width of the jaws of the gripping device shown in FIG. 5 is substantially twice the width of the jaws shown for the gripping device of FIG. 6. It has been determined that the smaller size gripping device is ideally suited for use with compact or sub-compact automobiles, whereas the larger size is often preferred for full size vehicles because the total gripping surface at the four quadrant points of the assembly is effectively doubled.

Although the present invention has been heretofore described in connection with a presently preferred embodiment and alternative modifications thereof, it is to be understood that other embodiments or variations may be made without departing from the spirit and scope of the invention, as those skilled in art will readily understand. Such embodiments and variations are considered to be within the purview and scope of the invention and the appended claims.

I claim:

1. A support assembly for stationarily securing an automobile in an elevated, substantially level position on a floor surface, including a freestanding bench structure having spaced-apart pedestals adapted for interconnection by an elongated crossbeam, each of said pedestals having a vertically-oriented weight-bearing portion terminating upwardly in an integral pocket, said pocket having a laterally-facing opening, a tension leg projecting in a direction generally opposite from said opening, said pocket being adapted to fittably receive therein an end of said crossbeam, said pocket having a back plate portion defining the end of said pocket opposite said opening, means for adjustably securing an end of said crossbeam to said back plate and selectively adjusting the distance between the crossbeam end and said back plate, said tension leg having means at its outer end to removably connect it to a stationary anchor whereby selective adjustment of the securing means to close the distance between said crossbeam and said back plate at either of said pedestals will exert a pulling force on said tension leg and thereby firmly secure the bench to said anchor.

2. The support assembly of claim 1 wherein the means of securing said end of said crossbeam to said back plate comprises:

a threaded stud projecting from said end of said crossbeam, a hole in said back plate for receiving said stud therethrough, and a nut threadably advancable on said stud to press against the outer surface of the back plate.

3. The support assembly of claim 1 wherein each of said pedestals is a rigid A-frame having spaced-apart lower end feet for contacting the floor surface.

4. The support assembly of claim 1 further comprising a pair of spaced-apart clamping jaw devices slidably mounted on the upper surface of said crossbeam.

5. The support assembly of claim 4 wherein the crossbeam has an upwardly-facing flat surface on which the clamping jaw devices are supported, said flat surface is provided with slot means, and each of said jaw devices has a releasable locking means engageable through said slot.

6. The support assembly of claim 4 wherein each of said clamping jaw devices comprise a first normally stationary jaw, a second jaw movable relative to said first jaw to exert a clamping action therebetween, and means for manually locking said second jaw in a clamping position.

7. The support assembly of claim 1 wherein said tension leg is a rigid member and has an integral hook end for gripping said anchor.

* * * * *